US009093030B2

(12) United States Patent
Liang et al.

(10) Patent No.: US 9,093,030 B2
(45) Date of Patent: Jul. 28, 2015

(54) DRIVING APPARATUS, OLED PANEL AND METHOD FOR DRIVING OLED PANEL

(75) Inventors: Yinan Liang, Beijing (CN); Zhanjie Ma, Beijing (CN); Chunping Long, Beijing (CN); Jun Cheng, Beijing (CN); Lei Shi, Beijing (CN); Dongfang Wang, Beijing (CN); Chunsheng Jiang, Beijing (CN); Zheng Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 280 days.

(21) Appl. No.: 13/486,051

(22) Filed: Jun. 1, 2012

(65) Prior Publication Data

US 2012/0306398 A1 Dec. 6, 2012

(30) Foreign Application Priority Data

Jun. 2, 2011 (CN) ..... 2011 1 0147548

(51) Int. Cl.
*G09G 5/00* (2006.01)
*G09G 3/32* (2006.01)

(52) U.S. Cl.
CPC ..... *G09G 3/3283* (2013.01); *G09G 2310/0248* (2013.01)

(58) Field of Classification Search
CPC ..... H05B 37/02; H05B 33/0896
USPC ..... 315/210; 345/77, 99, 204, 690
See application file for complete search history.

(56) References Cited

U.S. PATENT DOCUMENTS 6,424,331 B1 * 7/2002 Ozawa ..... 345/98
6,580,411 B1 * 6/2003 Kubota et al. ..... 345/98
7,830,350 B2 * 11/2010 Joo ..... 345/99
2004/0246241 A1 * 12/2004 Sato et al. ..... 345/204
2005/0116967 A1 * 6/2005 Shirasaki et al. ..... 345/690
2005/0140598 A1 * 6/2005 Kim et al. ..... 345/76
2005/0168416 A1 * 8/2005 Hashimoto et al. ..... 345/76
2005/0270205 A1 * 12/2005 Jo et al. ..... 341/144
2005/0280613 A1 12/2005 Takei et al.

(Continued)

FOREIGN PATENT DOCUMENTS

CN 1648971 A 8/2005
CN 1702972 A 11/2005

(Continued)

OTHER PUBLICATIONS

KIPO Office Action dated Aug. 28, 2013; Appln. No. 10-2012-0059721.

(Continued)

*Primary Examiner* — Tung X Le
(74) *Attorney, Agent, or Firm* — Ladas & Parry LLP

(57) ABSTRACT

The present disclosure relates to a driving apparatus, an OLED (Organic Light-Emitting Diode) panel, and a method for driving the OLED panel. The driving apparatus can be integrated on a substrate of pixel circuits and is capable of providing fast and stable current driving. The driving apparatus includes a switching module for selecting a voltage signal according to a received clock signal; a conversion module for converting the voltage signal into a current signal; and an output module for outputting the voltage signal or the converted current signal to drive a pixel circuit array, wherein the switching module is connected to the conversion module and the output module, and the conversion module is connected to the switching module and the output module.

15 Claims, 9 Drawing Sheets

(56) References Cited

U.S. PATENT DOCUMENTS

| | | | | |
|---|---|---|---|---|
| 2006/0139261 | A1* | 6/2006 | Choi et al. | 345/76 |
| 2007/0217275 | A1* | 9/2007 | Abe | 365/203 |
| 2008/0290805 | A1* | 11/2008 | Yamada et al. | 315/169.1 |
| 2009/0040212 | A1 | 2/2009 | Wang | |

FOREIGN PATENT DOCUMENTS

| | | | |
|---|---|---|---|
| CN | 1785313 | A | 6/2006 |
| KR | 20050078243 | A | 8/2005 |

OTHER PUBLICATIONS

EPO Examination Report dated Oct. 16, 2013; Appln. No. 12 170 421.7—1903.

First Chinese Office Action dated Nov. 19, 2013; Appln. No. 2011101474548.5.

European Search Report; dated Jun. 7, 2012; Appln. No. 12170421.7—228.

* cited by examiner

DRIVING APPARATUS, OLED PANEL AND METHOD FOR DRIVING OLED PANEL

CROSS REFERENCE TO RELATED APPLICATIONS

This application claims the benefit of Chinese Application No. 201110147548.5, filed Jun. 2, 2011, the entire disclosure of which is incorporated herein by reference.

TECHNICAL FIELD OF THE DISCLOSURE

The present disclosure relates to a driving apparatus, an OLED (Organic Light-Emitting Diode) panel, and a method for driving OLED panel.

BACKGROUND

A display adopting OLED (Organic Light-Emitting Diode) is a newly developing flat panel display device. Due to the advantages of the display adopting OLED, such as simple preparation process, low cost, fast response speed, easy to achieve color display and a large display screen, low power consumption, easy to match a integrated circuit driver, high luminance, wide range of operating temperature, thin and light structure, easy to achieve flexible display, and the like, so the display adopting OLED has a wide range of applications.

According to the driving manners, OLED can be divided into two different types: Passive Matrix Organic Light Emission Display (PMOLED) and Active Matrix Organic Light Emission Display (AMOLED). The Passive Matrix Organic Light Emission Display has a simple preparation process and a low cost, but has the disadvantages of crosstalk, high power consumption, and short life-span, etc., and thus does not meet the requirements of display with high resolution and large size. On the contrary, Active Matrix Organic Light Emission Display allows a pixel unit to emit light during the period of a frame by incorporating Thin Film Transistors (TFT) in the panel, and thus has the advantages of low driving current being required, low power consumption and long life-span and is capable of satisfying the requirements of display with high resolution, multiple grey levels and large size.

However, TFT has a threshold voltage, and the drift of the threshold voltage will cause non-uniformity of the luminance of OLED. Various pixel compensation circuits are proposed to solve the above problem, and can be divided, according to driving signals, into two different types: Voltage Programmed Pixel Circuit (VPPC) and Current Programmed Pixel Circuit (CPPC). CPPC is capable of compensating the effects of threshold voltage of TFT, carrier mobility and temperature. Meanwhile, the luminance of OLED can be controlled more accurately by adopting CCPC, since OLED is a current-driving device, the luminance of which is proportion to the current flowing through OLED.

The configuration of a current driving pixel unit of current mirror type in the prior art is shown in FIG. 1, and the timing sequence for controlling the pixel unit shown in FIG. 1 is illustrated in FIG. 2. In FIGS. 1, A2 and A4 are controlled to be tuned on alternatively, and OLED is driven by A1. Such a configuration is capable of compensating the variation of the output current caused by such factors as the parameters of devices in a pixel current array and the temperature. Nevertheless, the main defect of the pixel circuit shown in FIG. 1 lies in the parasitic capacitances generated by the switching transistors A2 and A3 and the overlap capacitances between signal lines, wherein the overlap capacitances causes the Current Programmed Pixel Circuit to take a long time to achieve a stable current in the condition of low grey level and low current, which in turn severely constrains the application of the pixel unit of current driving type in a display of large dimension and high resolution.

SUMMARY

In view of the above, the present disclosure provides a driving apparatus, an OLED panel and a method for driving the OLED panel, for providing fast and stable data current and thus achieving the driving of pixel circuit of current driving type and compensation for the threshold voltage of TFT.

In an embodiment of the present disclosure, there is provided a driving apparatus including a switching module for selecting a voltage signal according to a received clock signal; a conversion module for converting the voltage signal into a current signal; and an output module for outputting the voltage signal or the converted current signal to drive a pixel circuit array, wherein an output terminal of the switching module is connected to an input terminal of the conversion module and an input terminal of the output module, and an output terminal of the conversion module is connected to an input terminal of the output module.

In an embodiment of the present disclosure, there is provided an OLED panel including substrate and a pixel circuit array formed on the substrate, as well as the driving apparatus.

In an embodiment of the present disclosure, there is provided a method for driving an OLED panel including the steps of: inputting a first level signal from a clock signal generating module to a switching module; transmitting a received data voltage signal from an output module to a pixel circuit array; inputting a second level signal from the clock signal generating module to the switching module; converting by a conversion module the received data voltage signal into a data current signal; transmitting the data current signal from the output module to the pixel circuit array to drive OLED.

In an embodiment of the present disclosure, there is provided a driving apparatus including a switching module for selecting a voltage signal according to a received clock signal; a conversion module for converting the voltage signal into a current signal; and an output module for outputting the voltage signal or the converted current signal to drive a pixel circuit array, wherein the switching module is connected to the conversion module and the output module, and the conversion module is connected to the switching module and the output module. The driving apparatus according to the embodiment of the present disclosure selects the voltage signal by the switching module, and thus can firstly output the voltage signal, quickly charge/discharge parasitic capacitance on a data line by the voltage signal, and then output a current signal. So, the effect of the parasitic capacitance on the current signal is reduced and the output current can achieve a stable state quickly, which thus is helpful for the stable driving of the pixel circuit array. Meanwhile, the circuit of driving current type can effectively compensate the effects of such factors as threshold voltage of TFT, carrier mobility, temperature, and the like.

BRIEF DESCRIPTION OF THE DRAWINGS

The present disclosure will become more fully understood from the detailed description given hereinafter and the accompanying drawings which are given by way of illustration only, and thus are not limitative of the present disclosure and wherein.

DETAILED DESCRIPTION

In summary, a driving apparatus according to an embodiment of the present disclosure includes a switching module for selecting a voltage signal according to a received clock signal; a conversion module for converting the voltage signal into a current signal; and an output module for outputting the voltage signal or the converted current signal to drive a pixel circuit array, wherein the switching module is connected to the conversion module and the output module, and the conversion module is connected to the switching module and the output module. The driving apparatus according to the embodiment of the present disclosure can firstly output the voltage signal by selecting the voltage signal with the switching module, and quickly charge/discharge parasitic capacitance across data lines by the voltage signal, then output a current signal so as to reduce the effect of the parasitic capacitance on the current signal, so that the current signal can reach a stable state quickly, decreasing the non-uniformity of the output current and facilitating the stable driving of the pixel circuit array. Meanwhile, Current Programmed Pixel Circuit can effectively compensate the effects of such factors as threshold voltage of TFT, carrier mobility, temperature, and the like.

OLED panel according to an embodiment of the present disclosure includes a substrate, a pixel circuit array formed on the substrate, and a driving apparatus. An input terminal of the pixel circuit array is connected to an output terminal of the driving apparatus. That is, a data line of the pixel circuit array is connected to the output terminal of the driving apparatus.

Figure 1:
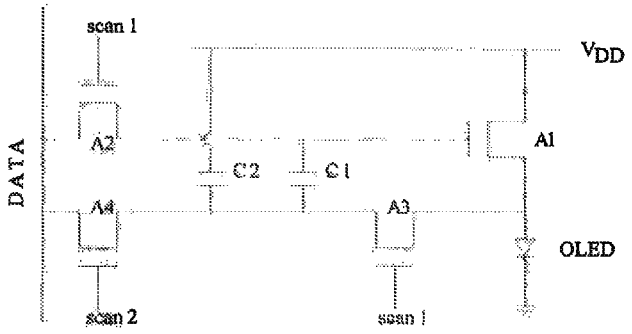
Prior Art Fig.1
FIG. 1 is a schematic diagram showing a driving pixel unit apparatus in the prior art.
Figure 2:
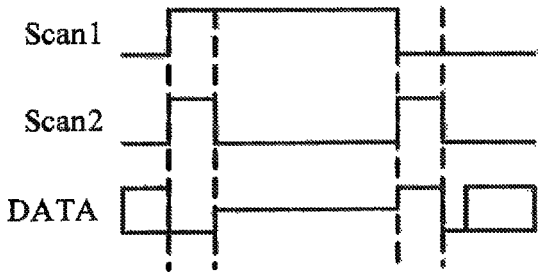
Prior Art Fig.2
FIG. 2 is a timing sequence diagram of the driving pixel unit apparatus shown in FIG. 1.
Figure 3:
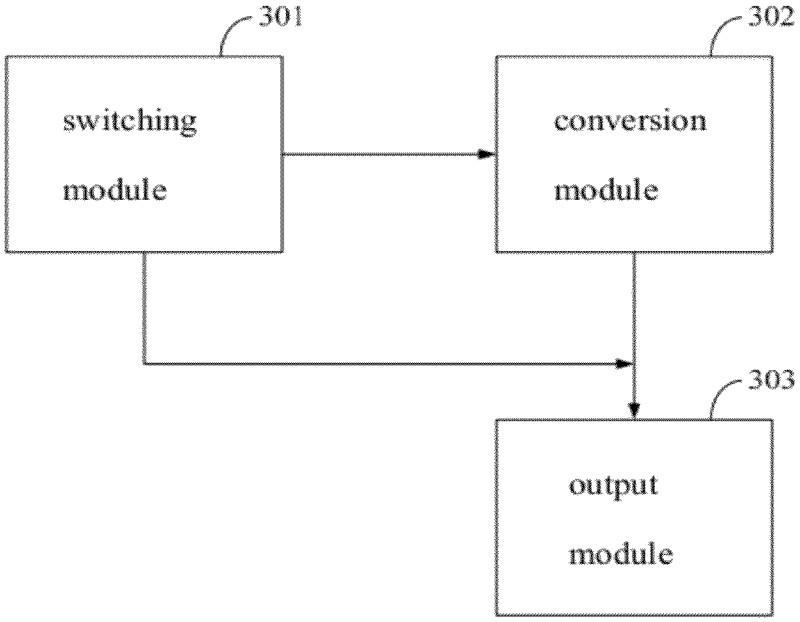
FIG. 3 is a main block diagram of a driving apparatus according to an embodiment of the present disclosure.

Referring to FIG. 3, the driving apparatus according to an embodiment of the present disclosure includes a switching module 301, a conversion module 302 and an output module 303. A first output terminal of the switching module 301 is connected to an input terminal of the conversion module 302, a second output terminal of the switching module 301 is connected to an input terminal of the output module 303, and an output terminal of the conversion module 302 is connected to an input terminal of the output module 303. All of the transistors used in the embodiment of the present disclosure may be TFT (Thin Film Field Effect Transistor).

Figure 4:
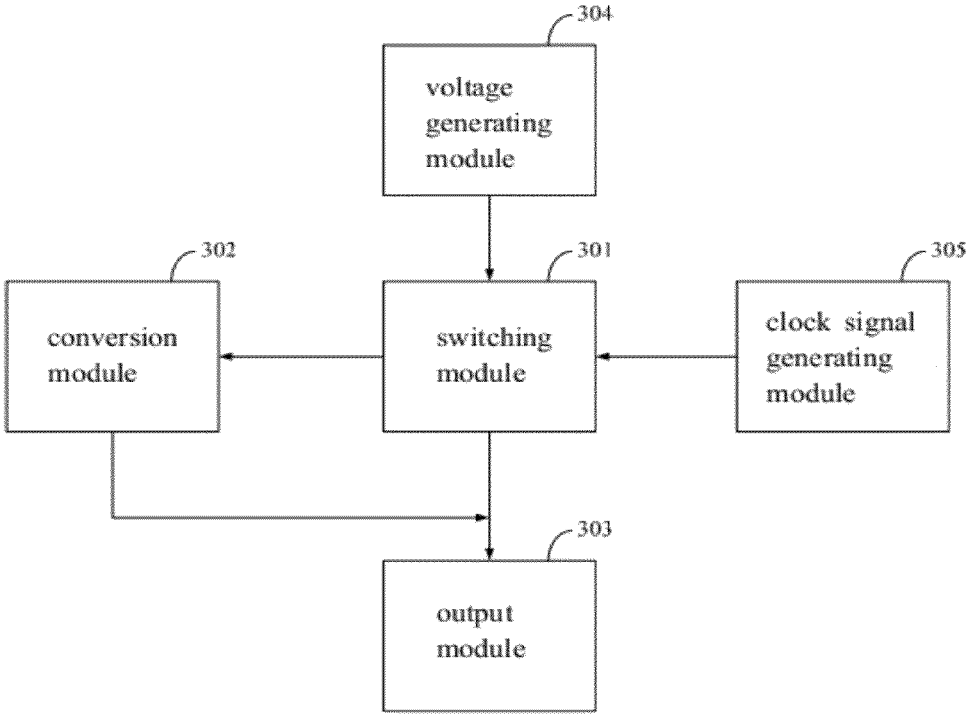
FIG. 4 is a detail block diagram of the driving apparatus according to the embodiment of the present disclosure.

Referring to FIG. 4, the driving apparatus can further include a voltage generating module 304 and a clock signal generating module 305. An output terminal of the clock signal generating module 305 is connected to a first input terminal of the switching module 301, and an output terminal of the voltage generating module 304 is connected to a second input terminal of the switching module 301.

Referring to FIG. SA, a specific configuration diagram of the driving apparatus according to the embodiment of the present disclosure is shown. The switching module 301 in the embodiment of the present disclosure may be a switching circuit. The switching module 301 is used to select and output a voltage signal according to a received clock signal. The switching module 301 can include a first switching transistor (hereinafter, referred to as T1) and a second switching transistor (hereinafter, referred to as T2). A gate of T1 is connected to a gate of T2, and is connected to the clock signal generating module 305; a source of T1 is connected to a drain of T2, and is connected to the voltage generating module 304; a drain of T1 is connected to the conversion module 302, and a source of T2 is connected to the output module 303, that is, to a data line of the pixel circuit array via the output module 303. The switching module 301 has two input terminals and two output terminals, wherein a first input terminal is the terminal at which the gate of T1 and the gate of T2 are connected, a second input terminal is the terminal at which the source of T1 and the drain of T2 are connected, a first output terminal is the terminal connected with the drain of T1, and a second output terminal is the terminal connected with the source of T2. T1 and T2 in the embodiment of the present disclosure are TFTs with opposite polarity, for example, T1 is a P type TFT and T2 is a N type TFT so that T1 and T2 are complementary, and only one control signal is required for controlling T1 and T2 to be on or off. Alternatively, T1 and T2 may also be TFTs with the same polarity, for example, both T1 and T2 are P type TFTs or N type TFTs, and two control signals are required at this time to control T1 and T2 respectively. Or, T1 and T2 may be triodes instead of TFTs, nevertheless the field effect transistor is a voltage-controlled device and the triode is a current-controlled device, and thus the switching module 301 adopting the field effect transistor has a better effect than that adopting the triode. Or, the switching module 301 may also adopts other circuits having a switching and selecting function. When T1 is a P type TFT and T2 is a N type TFT, the clock signal generating module 305 first outputs a high level signal, and thus T1 turns off and T2 turns on, so that a data voltage signal generated by the voltage generating module 304 arrives at a data line via T2 and the output module 303. The data voltage signal can charge the parasitic capacitance on the data line quickly. After that, the signal generated by the clock signal generating module 305 changes from the high level to a low level, and thus T1 turns on and T2 turns off, so the data voltage signal generated by the voltage generating module 304 does not flow directly into the output module 303, but enters into the conversion module 302 via T1.

The conversion module 302 is used to convert a received voltage signal into a current signal and output the same. The conversion module 302 includes a first transistor M1, a second transistor M2, a third transistor M3, a fourth transistor M4, a fifth transistor M5, a sixth transistor M6, a seventh transistor M7, a eighth transistor M8, a ninth transistor M9 and a tenth transistor M10. A gate of M1 is connected to the drain of T1 in the switching module 301; a drain of M1 is connected to a drain and a gate of M3 and a gate of M4; a source of M1 is connected to a source of M6, a gate and a drain of M9, and a source of M10, and is grounded; a gate and a drain of M2 is connected to a gate of M5, a drain of M4 and a gate of M10; a source of M2 is connected to a source of M9, a source of M5 and a gate of M6; a source of M3 is connected to a source of M4, a source of M7 and a source of M8 and to a first power supply VDD with a certain potential, and VDD may be an output terminal of a power supply line for supplying power in the embodiment of the present disclosure; a drain of M5 is connected to a drain and a gate of M7, and a gate of M8; a drain of M6 is connected to a drain of M8; a drain of M10 is connected to the source of T2 in the switching module 301, and both are connected to the output module 303 together, that is, both are connected to the data line of the pixel circuit array together via the output module 303. In the embodiment of the present disclosure, M1, M2, M5, M6 and M10 are all N type TFTs, and M3, M4, M7, M8 and M9 are all P type TFTs. The polarities of M1-M10 can be changed, but M1, M2, M5, M6 and M10 should be of the same polarity, and M3, M4, M7, M8 and M9 should be of the same polarity. Under such a circumstance, connections among the respective elements in the circuit can be changed respectively according to the polarities of TFTs, and those skilled in the art can easily make the corresponding variations according to the prior art and the concept of the present invention, so no more descriptions and diagrams are detailed here.

M1, M2, M3 and M4 constitute a cascode mirror current source configuration for implementing the conversion from a data voltage signal to a data current signal. The configuration may also be substituted by other configuration units having the function of voltage conversion.

Figure 5A:
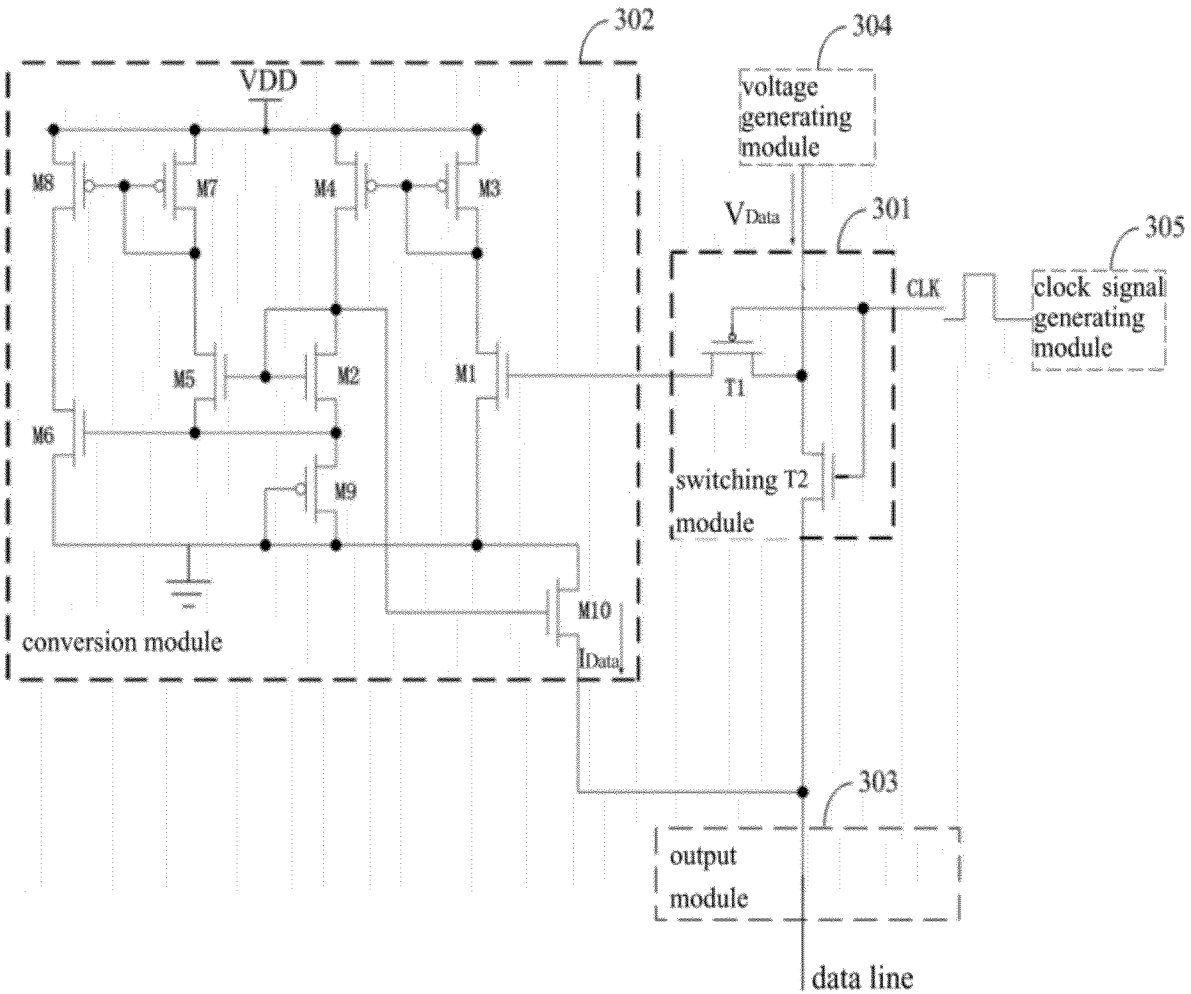
FIG. 5A is a specific configuration diagram of the driving apparatus according to the embodiment of the present disclosure.
Figure 5B:
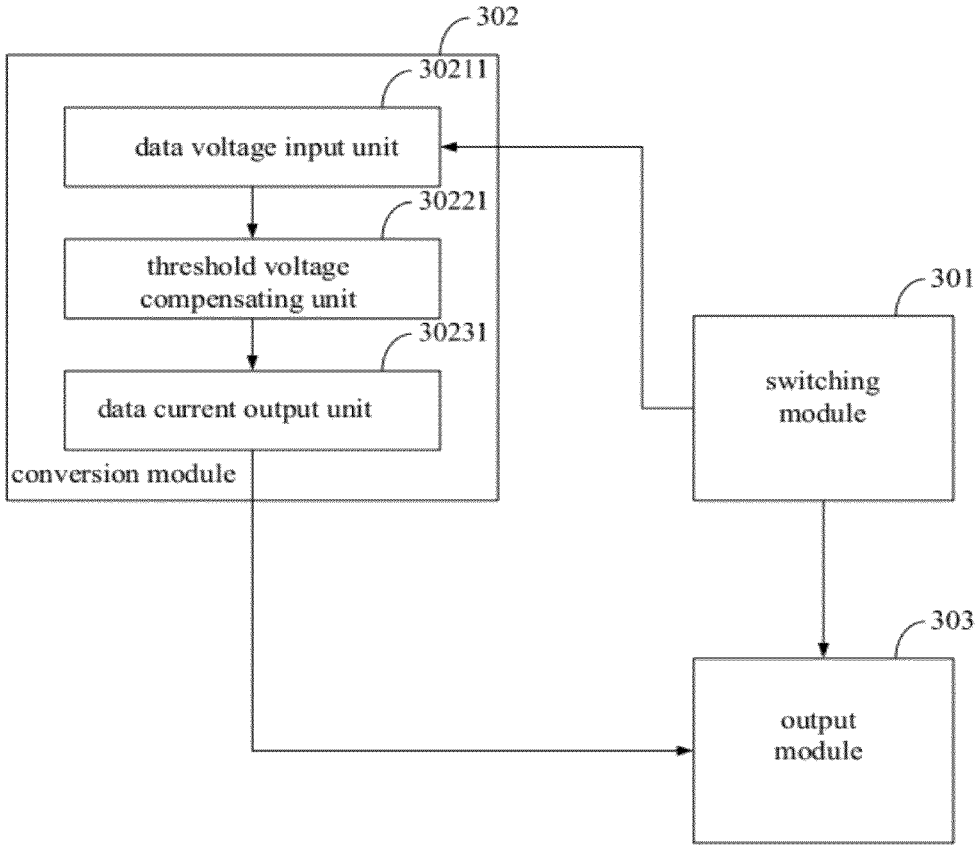
FIG. 5B is a detail block diagram of the conversion module and a connection diagram of the conversion module and other modules in the embodiment of the present disclosure.

Referring to FIG. 5B, a detailed block diagram of the conversion module 302 in the embodiment of the present disclosure is shown. The conversion module 302 includes a data voltage input unit 30211, a threshold voltage compensating unit 30221, and a data current output unit 30231. An input terminal of the data voltage input unit 30211 is connected to the first output terminal of the switching module 301, an output terminal of the data voltage input unit 30211 is connected to an input terminal of the threshold voltage compensating unit 30221, an output terminal of the threshold voltage compensating unit 30221 is connected to an input terminal of the data current output unit 30231, and an output terminal of the data current output unit 30231 is connected to the input terminal of the output module 303.

M1, M2, M3, M4 and M9 constitute the data voltage input unit 30211 for converting the received data voltage signal into the data current signal. The data voltage input unit 30211 may also be substituted by other configurations having the function of converting a data voltage into a data current. M5, M6, M7 and M8 constitute the threshold voltage compensating unit 30221, which implements the compensation for threshold voltage of TFT by designing TFT with different width/length ratio of channel. That is, the threshold voltage compensating unit 30221 is used to compensate the threshold voltage of the transistor. Such a configuration may also be substituted by other configuration units having the function of compensating the threshold voltage of TFT. M10 constitutes the data current output unit 30231 for outputting the converted data current signal, and is connected to the pixel circuit array via the output module 303 for inputting the data current signal to the pixel circuit array. The data voltage input unit 30211 can be also referred as a first data voltage input unit.

When T1 turns on and T2 turns off in the switching module 301, the data voltage signal $V_{Data}$ enters into the conversion module 302 through the gate of M1. The gate and drain of M3 are connected together, and thus M3 operates always in the saturation region after it turns on. At the same time, the source voltage of M3 is the same as that of M4, and the gate voltage of M3 is the same as that of M4. It can be seen from FIG. 5A that the current of M1 is the same as that of M3, and the current of M2 is the same as that of M4. The following equations can be obtained according to the formulae for calculating the current of TFT in the saturation region.

$$I_{M1}=I_{M3}=\tfrac{1}{2}(W/L)_{M1}C_{OX}\mu_n(V_{Data}-V_{Th})^2 \quad (1)$$

$$I_{M2}=I_{M4}=\tfrac{1}{2}(W/L)_{M2}C_{OX}\mu_n(V_{Out}-V_A-V_{Th})^2 \quad (2)$$

$$I_{M1}*I_{M2}=I_{M3}*I_{M4} \quad (3)$$

wherein W represents the length of channel of TFT, L represents the width of channel of TFT, Cox represents the capacitance of the insulating layer of TFT, $\mu_n$ represents the carrier mobility, and $V_{Th}$ represents the threshold voltage of TFT. $V_A$ represents the source voltage of M5 in FIG. 5A, and $V_{out}$ represents the drain voltage of M2 in FIG. 5A.

TFT can be designed as $(W/L)_{M2}*(W/L)_{M4}=4(W/L)_{M1}*(W/L)_{M3}$ so as to obtain:

$$V_{Out}=\tfrac{1}{2}V_{Data}+V_A+\tfrac{1}{2}V_{Th} \quad (4)$$

Meanwhile, the length/width ration of channel of M5 and that of M6 can be designed to be the same, that is, $(W/L)_{M5}=(W/L)_{M6}$, and M7 and M8 are in a cascode connection, so the current flowing through M7 is the same as that flowing through M8, that is, $I_{M7}=I_{M8}$, and we can obtain:

$$I_{M7}=I_{M5}=\tfrac{1}{2}(W/L)_{M5}C_{OX}\mu_n(V_{OUT}-V_A-V_{Th})^2 \quad (5)$$

$$I_{M8}=I_{M6}=\tfrac{1}{2}(W/L)_{M6}C_{OX}\mu_n(V_A-V_{Th})^2 \quad (6)$$

$$V_{Out}=2V_A \quad (7)$$

Then we can obtain:

$$V_{out}=V_{Data}+V_{Th} \quad (8)$$

Then, the data current output from M10 can be:

$$I_{Data}=\tfrac{1}{2}(W/L)_{M10}C_{OX}\mu_n(V_{Out}-V_{Th})^2=\tfrac{1}{2}(W/L)_{M10}C_{OX}\mu_n V_{Data}^2 \quad (9)$$

It can be seen that the data current output from M10 is independent of the threshold voltage of TFT in the driving apparatus, that is to say, the drift of the threshold voltage of TFT will not affect the output current of the driving apparatus, and thus the compensation for the threshold voltage of TFT can be achieved.

With the conversion module 302, the conversion from the data voltage signal to the data current signal can be implemented, and thus the pixel circuit array of current driving type can be driven by a chip for providing voltage driving. As a result, the technical problem of the pixel circuit array of current driving type lacking corresponding source driving Integrated Circuit Chips can be solved, while maintaining the advantages of high stability and high accuracy of the pixel circuit array of current driving type. At the same time, the conversion module 302 is capable of compensating the threshold voltage of TFT, and thus a stable output of the data current is achieved.

Under the control of the clock signal generating module 305, the pixel circuit array is driven by a constant data voltage signal in a first stage and by a constant data current signal in a second stage. As compared with the conventional driving manner, the effects of the driving manner according to the embodiment of the present disclosure and the conventional driving manner are the same in the stage of OLED emitting light; however in the stage of driving, the driving apparatus proposed in the embodiment of the present disclosure can make the driving current achieve a stable state quickly and thus has a better effect on the driving for the pixel circuit array.

The output module 303 is used to output the voltage signal or the converted current signal to drive the pixel circuit array. More specifically, the output module 303 may be a lead wire which is connected to the input terminal of the data line. The output terminal of the data line is connected to the pixel circuit array.

The voltage generating module 304 is used to generate the data voltage signal.

The clock signal generating module 305 is used to generate a clock signal. More specifically, the clock signal generating module 305 can generate a changing clock signal. For example, the clock signal generating module 305 in the embodiment of the present disclosure first generates a first level signal, that is, a high level signal in the embodiment of the present disclosure, and then generates a second level signal, that is, a low level signal in the embodiment of the present disclosure. The signal generated by clock signal generating module 305 can change correspondingly according to the polarity of TFT in the driving apparatus.

Figure 6A:
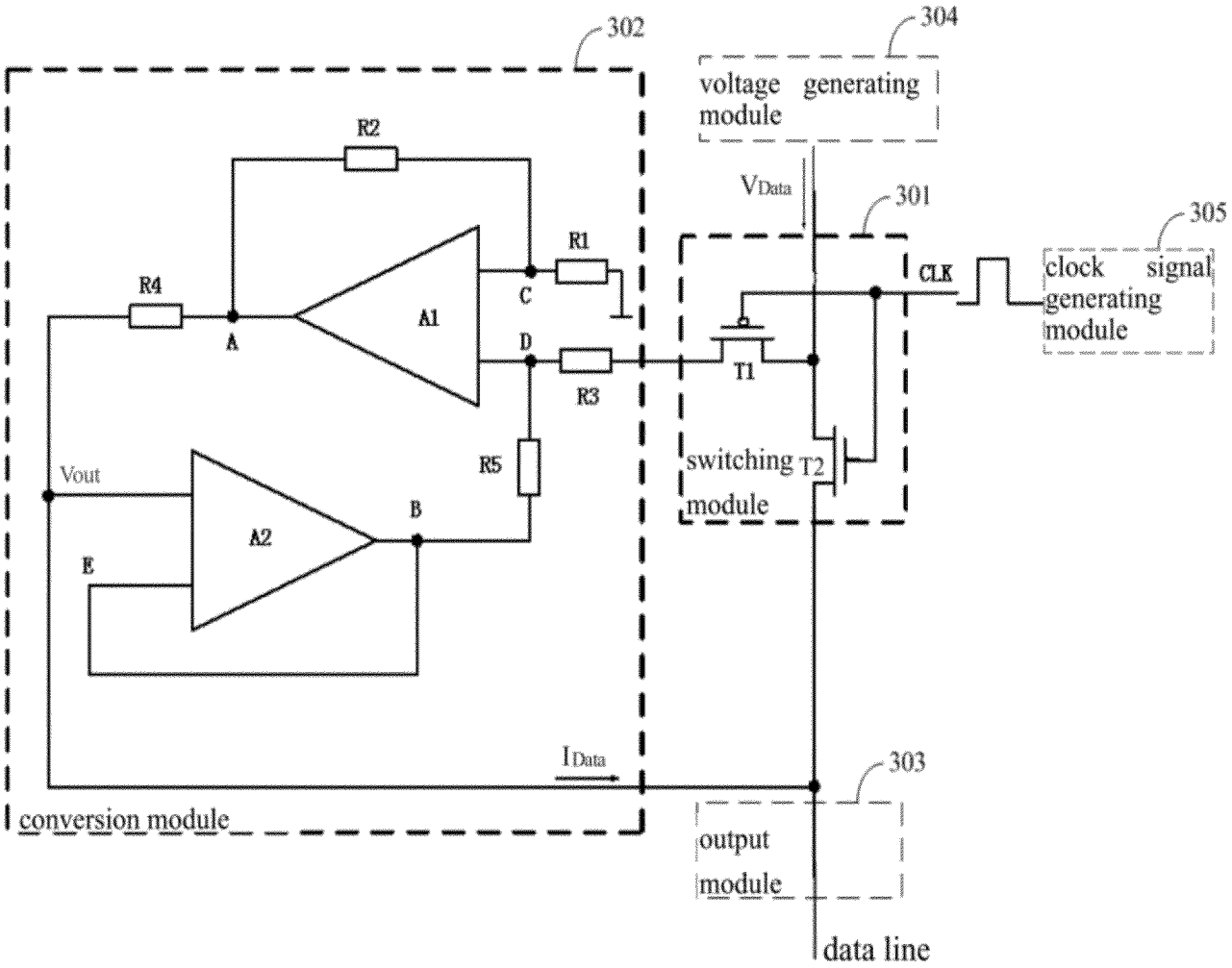
FIG. 6A is a detail configuration diagram of the driving apparatus with a conversion module being implemented in another manner in an embodiment of the present disclosure.

Referring to FIG. 6A, a specific configuration diagram of the driving apparatus with a conversion module 302 being implemented in another manner according to an embodiment of the present disclosure is shown.

Figure 6B:
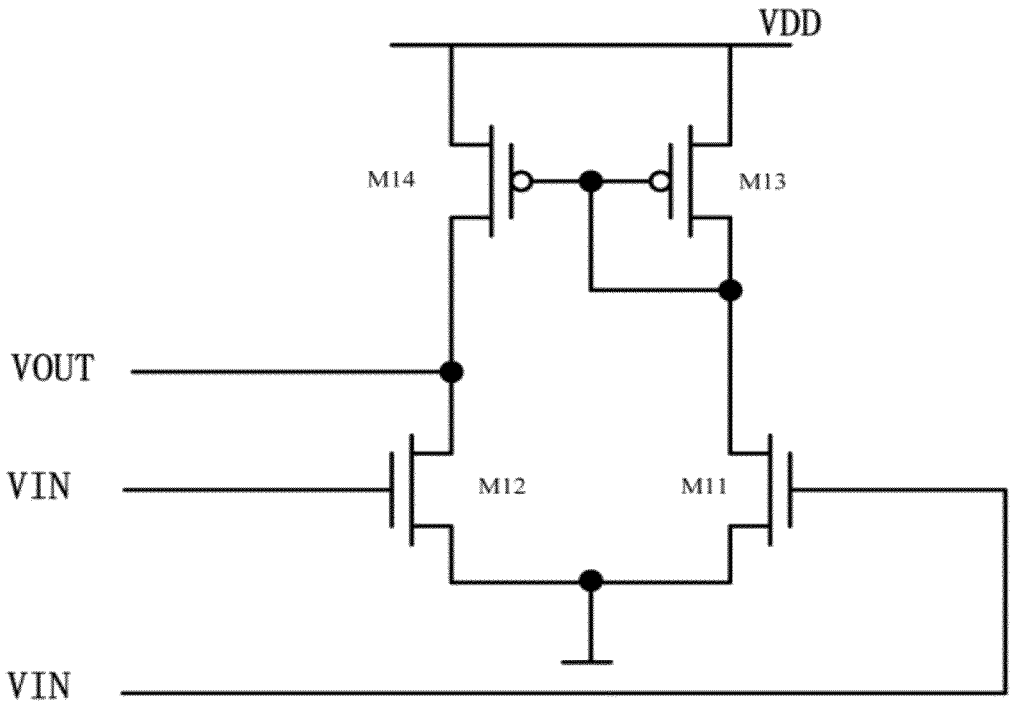
FIG. 6B is a schematic diagram of the operational amplifier in the embodiment of the present disclosure.

The conversion module 302 is used to convert a received voltage signal into a current signal. The conversion module 302 includes a first amplifier A1, a second amplifier A2, a first resistor R1, a second resistor R2, a third resistor R3, a fourth resistor R4, and a fifth resistor R5. A terminal of R3 is connected to the drain of T1 in the switching module 301; another terminal of R3 is connected to a terminal of R5 and to a first input terminal of A1 (terminal D in FIG. 6A); a terminal of R1 is grounded, and another terminal of R1 is connected to a terminal of R2 and to a second input terminal of A1 (that is, terminal C in FIG. 6A); another terminal of R2 is connected to a terminal of R4 and to an output terminal of A1 (that is, terminal A in FIG. 6A); another terminal of R4 is connected to a first input terminal of A2 (that is, terminal Vout in FIG. 6A); another terminal of R5 is connected to an output terminal of A2 (that is, terminal B in FIG. 6A); a second input terminal of A2 (that is, terminal E in FIG. 6A) is connected to the output terminal of A2; and the terminal Vout is connected to the output module 303. A1 and A2 are cascode operational amplifiers, the schematic diagram of which is shown in FIG. 6B. The cascode operational amplifier includes four TFTs (M11, M12, M13 and M14), which is similar to a differential circuit and can suppress zero drift. In the embodiment of the present disclosure, R1, R2, R3, R4 and R5 have the same resistance.

Figure 6C:
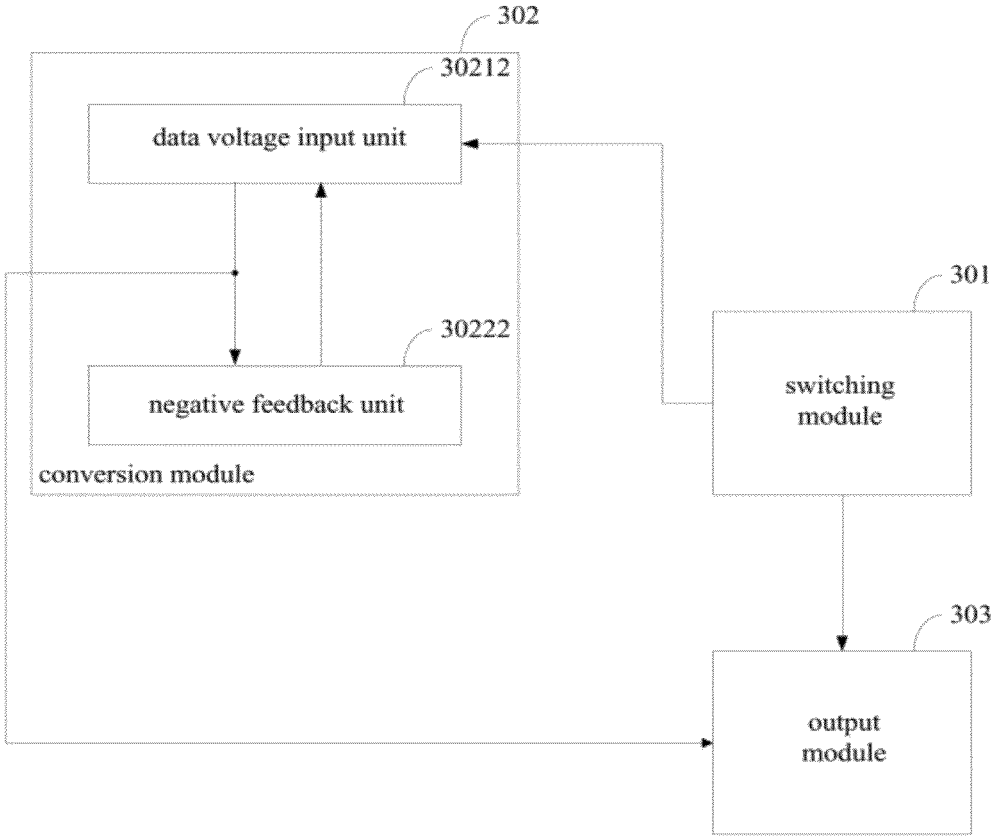
FIG. 6C is a detail block diagram of the conversion module and a connection diagram of the conversion module and other modules in another embodiment of the present disclosure.

Referring to FIG. 6C, a detail block diagram of another conversion module 302 according to an embodiment of the present disclosure is shown. The conversion module 302 includes a data voltage input unit 30212 and a negative feedback unit 30222. A1, R1, R2, R3 and R4 constitute the data voltage input unit 30212 for converting the received data voltage signal into the data current signal. The data voltage input unit 30212 can also be substituted by other configuration units having the function of voltage converting. A2 and R5 constitute the negative feedback unit 30222 for compensating the threshold voltage of transistor. With the negative feedback circuit, the constancy of gain can be effectively increased, the non-linear distortion can be effectively reduced, the noise in the feedback loop can be effectively suppressed, and the frequency band can be effectively extended. The negative feedback unit 30222 can also be substituted by other configuration units having the effect of feedback. An input terminal of the data voltage input unit 30212 is connected to the first output terminal of the switching module 301, an output terminal of the data voltage input unit 30212 is connected to an input terminal of the negative feedback unit 30222 and the input terminal of the output module 303, and an output terminal of the negative feedback unit 30222 is connected to an input terminal of the data voltage input unit 30212. The data voltage input unit 30212 cal also be referred to as a second data voltage input unit.

When T1 turns on and T2 turns off in the switching module 301, the data voltage signal enters the conversion module 302 via R3. The data voltage signal $V_{Data}$ generated by the voltage generating module 304 is applied to the first input terminal of A1 via R3. According to the principle of the operational amplifier, the voltage at the terminal C and the voltage at the terminal D in FIG. 6A satisfy the following equation:

$$V_C=V_D \tag{10}$$

For the same reasons, $$V_E=V_B=V_{OUT} \tag{11}$$

According to the Law of Current Conservation, $$(V_{DATA}-V_D)/R_3=(V_D-V_B)/R_5 \tag{12}$$

$$(V_A-V_{OUT})/R_4=(V_C-V_A)/R_2=(0-V_C)/R_1 \tag{13}$$

Since R1=R2=R3=R4=R5=R, so we can obtain:

$$V_A=2V_C=2V_D \tag{14}$$

$$V_{DATA}+V_{OUT}=2V_D \tag{15}$$

Then, we can obtain:

$$I_{Data}=(V_A-V_{OUT})/R=V_{DATA}/R \tag{16}$$

Consequently, the conversion from the data voltage signal to the data current signal can be implemented. Also it can be seen from the equation (16) that the output data current signal is independent of the threshold voltage of TFT, and thus the compensation for the threshold voltage of TFT can be achieved.

A method for driving a pixel circuit array will be described below by means of a specific flow.

Figure 7:
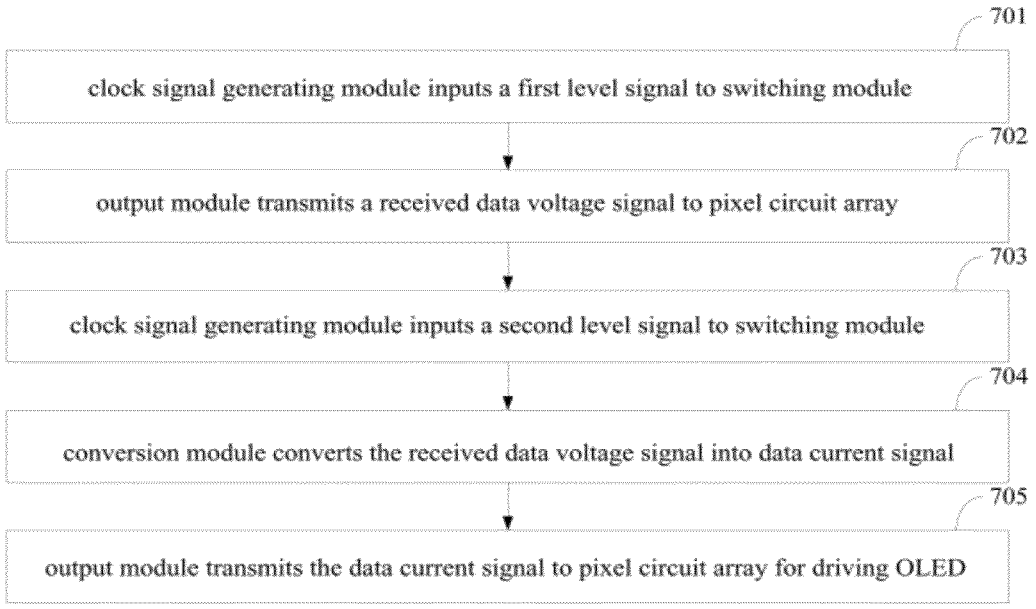
FIG. 7 is a main flowchart of a method for driving OLED panel according to an embodiment of the present disclosure.

Referring to FIG. 7, the main flow of the method for driving OLED panel according to the embodiment of the present disclosure is as follows:

At step 701, the clock signal generating module 305 inputs a first level signal to the switching module 301. The first level signal is a high level signal in the embodiment of the present disclosure.

At step 702, the output module 303 transmits a received data voltage signal to a pixel circuit array. In combination with FIG. 6, T1 turns off and T2 turns on in the switching module 301, so the switching module 301 transmits the received data voltage signal to the output module 303, and the output module 303 then transmits the received data voltage signal to the pixel circuit array.

At step 703, the clock signal generating module 305 inputs a second level signal to the switching module 301. The second level signal is a low level signal in the embodiment of the present disclosure.

At step 704, the conversion module 302 converts the received data voltage signal into a data current signal. Combining FIG. 6, T2 turns off and T1 turns on in the switching module 301, so the switching module 301 transmits the received data voltage signal to the conversion module 302, and the conversion module 302 then converts the received data voltage signal into the data current signal.

At step 705, the output module 303 transmits the data current signal to the pixel circuit array for driving OLED. After the conversion module 302 converts the received data voltage signal into the data current signal, the conversion module 302 transmits the data current signal obtained to the output module 303, and then the output module 303 transmits the data current signal to the pixel circuit array for driving OLED.

Figure 8:
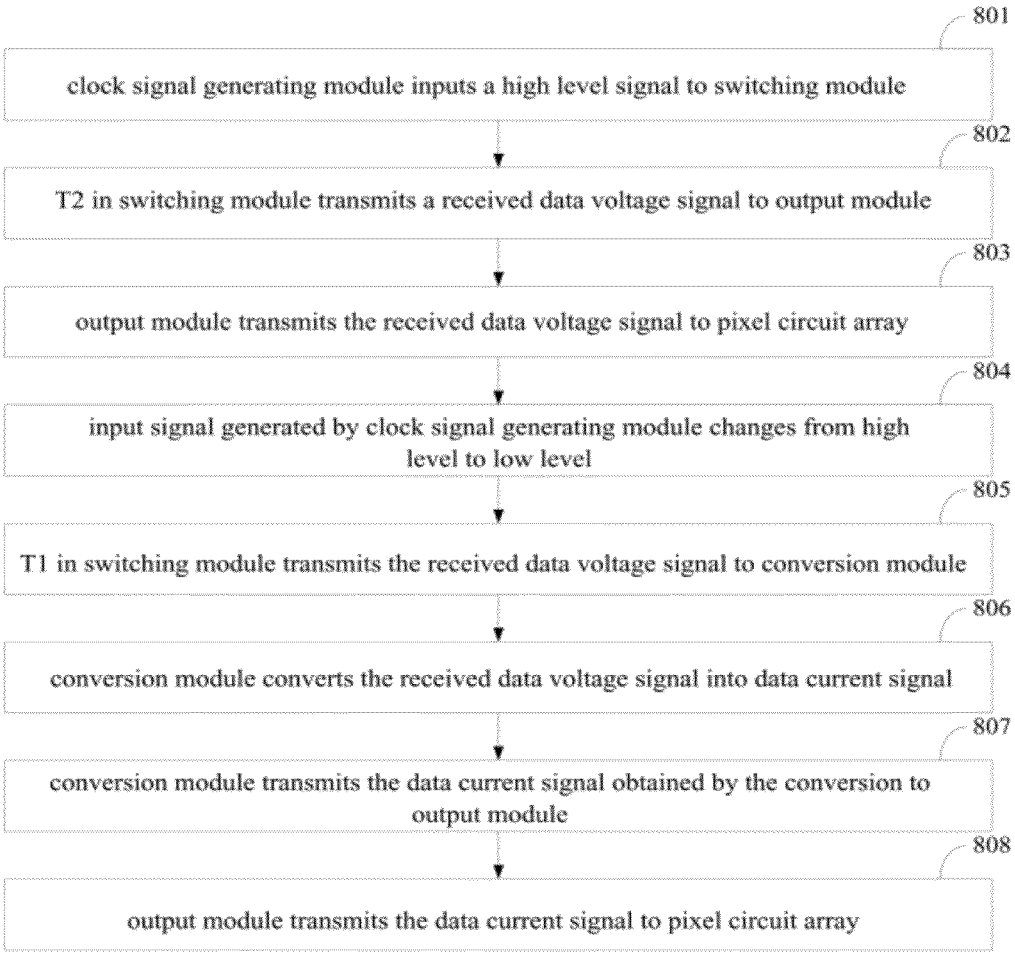
FIG. 8 is detail flowchart of the method for driving OLED panel according to an embodiment of the present disclosure.

Referring FIG. 8, the detailed flow of the method for driving OLED panel according to the embodiment of the present disclosure is as follows:

At step 801, the clock signal generating module 305 inputs a high level signal to the switching module 301. The embodiment of the present disclosure will be described in detail in conjunction with FIG. 6.

At step 802, T2 in the switching module 301 transmits a received data voltage signal to the output module 303, at this time, T1 in the switching module 301 turns off At step 803, the output module 303 transmits the received data voltage signal to the pixel circuit array.

At step 804, the input signal from the clock signal generating module 305 changes from a high level to a low level.

At step 805, T1 in the switching module 301 transmits the received data voltage signal to the conversion module 302, at this time, T2 in the switching module 301 turns off At step 806, the conversion module 302 converts the received data voltage signal into a data current signal.

At step 807, the conversion module 302 transmits the data current signal obtained by the conversion to the output module 303.

At step 808, the output module 303 transmits the data current signal to the pixel circuit array.

The driving apparatus according to the embodiment of the present disclosure includes a switching module 301 for selecting a voltage signal according to a received clock signal; a conversion module 302 for converting the voltage signal into a current signal; and an output module 303 for outputting the voltage signal or the converted current signal to drive a pixel circuit array, wherein the switching module 301 is connected to the conversion module 302 and the output module 303, and the conversion module 302 is connected to the switching module 301 and the output module 303. The driving apparatus according to the embodiment of the present disclosure selects the voltage signal by the switching module 301, and thus can firstly output the voltage signal, quickly charge/discharge parasitic capacitance across data lines by the voltage signal; and then output a current signal. Consequently, the effect of the parasitic capacitance on the current signal is reduced, so that the output current can achieve a stable state quickly, which thus is helpful for the stable driving of the pixel circuit array. Meanwhile, the pixel circuit of current driving type can effectively compensate the effects of such factors as threshold voltage of TFT, carrier mobility, temperature, and the like, and thus the stability of the circuit can be increased.

The benefits of the embodiments of the present disclosure lie in that, by controlling the switching module 301, a data voltage signal can firstly be output to quickly charge/discharge the parasitic capacitance on a data line, so that the electrical potential on the data line can be adjusted to close to a predetermined value in a short time while reducing the effect of the parasitic capacitance on the current signal. After that, the data voltage signal enters into the conversion module 302 under the control of the switching module 301 and is then converted to a data current signal corresponding to the data voltage signal, so as to directly drive a pixel circuit array by the data current signal, which expedites the driving process of the pixel circuit array of current driving type. As a result, the embodiment of the present disclosure may have the advantages of high accuracy and good stability. The data voltage signal in the embodiment of the present disclosure can be supplied directly by the existing data voltage generating IC (Integrated Circuit) for TFT-LCD (Thin Film Transistor-Liquid Crystal Display), so that the problem of the existing pixel circuit array of current driving type lacking a dedicated driving IC can be solved.

The above descriptions are only for illustrating the preferred embodiments of the present disclosure, and in no way limit the scope of the present disclosure. The embodiments of the disclosure being thus described, it will be obvious that the same may be varied in many ways. Such variations are not to be regarded as a departure from the spirit and scope of the disclosure, and all such modifications as would be obvious to those skilled in the art are intended to be included within the scope of the following claims.

What is claimed is:

1. A driving apparatus including:

a switching module for selecting and outputting a voltage signal according to a received clock signal;

a conversion module for converting the voltage signal into a current signal and outputting the current signal;

an output module for outputting the voltage signal or the converted current signal to drive a pixel circuit array; and a voltage generating module configured to generate a data voltage signal;

wherein a first output terminal of the switching module is connected to an input terminal of the conversion module, a second output terminal of the switching module is connected to an input terminal of the output module, and an output terminal of the conversion module is connected to an input terminal of the output module;

wherein the conversion module includes a data voltage input unit for converting the data voltage signal into a data current signal, a threshold voltage compensating unit for compensating the threshold voltage of transistor, and a data current output unit for outputting the data current signal converted;

wherein the data voltage input unit includes a first transistor, a second transistor, a third transistor, a fourth transistor, and a ninth transistor;

the threshold voltage compensating unit includes a fifth transistor, a sixth transistor, a seventh transistor, and an eighth transistor; and the data current output unit includes a tenth transistor, wherein a gate of the first transistor is connected to the first output terminal of the switching module; a drain of the first transistor is connected to a drain and a gate of the third transistor and a gate of the fourth transistor; a source of the first transistor is connected to a source of the sixth transistor, a gate and a drain of the ninth transistor, and a source of the tenth transistor, and is grounded; a gate and a drain of the second transistor are connected to a gate of the fifth transistor, a drain of the fourth transistor and a gate of the tenth transistor; a source of the second transistor is connected to a source of the ninth transistor, a source of the fifth transistor and a gate of the sixth transistor; a source of the third transistor is connected to a source of the fourth transistor, a source of the seventh transistor and a source of the eighth transistor and a first power supply terminal VDD; a drain of the fifth transistor is connected to a drain and a gate of the seventh transistor, and a gate of the eighth transistor; a drain of the sixth transistor is connected to a drain of the eighth transistor; and a drain of the tenth transistor is connected to the second output terminal of the switching module and the input terminal of the output module.

2. The driving apparatus of claim 1, further includes a clock signal generating module, wherein the clock signal generating module has an output terminal connected to a first input terminal of the switching module and is used for generating the clock signal; and the voltage generating module has an output terminal connected to a second input terminal of the switching module.

3. The driving apparatus of claim 2, wherein the switching module includes a first switching transistor and a second switching transistor, wherein a gate of the first switching transistor is connected to a gate of the second switching transistor and the output terminal of the clock signal generating module;

a source of the first switching transistor is connected to a drain of the second switching transistor and the output terminal of the voltage generating module;

a drain of the first switching transistor is connected to the input terminal of the conversion module; and a source of the second switching transistor is connected to the input terminal of the output module.

4. The driving apparatus of claim 3, wherein the first switching transistor and the second switching transistor are of opposite polarities.

5. The driving apparatus of claim 3, wherein the first switching transistor and the second switching transistor are Thin Film Field Effect Transistors.

6. The driving apparatus of claim 3, wherein an input terminal of the data voltage input unit is connected to the first output terminal of the switching module, an output terminal of the data voltage input unit is connected to an input terminal of the threshold voltage compensating unit, an output terminal of the threshold voltage compensating unit is connected to an input terminal of the data current output unit, and an output terminal of the data current output unit is connected to the input terminal of the output module.

7. The driving apparatus of claim 3, wherein the conversion module includes a data voltage input unit for converting the data voltage signal into the data current signal, and a negative feedback unit for compensating the threshold voltage of transistor, wherein an input terminal of the data voltage input unit is connected to the first output terminal of the switching module, an output terminal of the data voltage input unit is connected to an input terminal of the negative feedback unit and the input terminal of the output module, and an output terminal of the negative feedback unit is connected to the input terminal of the data voltage input unit.

8. The driving apparatus of claim 7, wherein the data voltage input unit includes a first amplifier, a first resistor, a second resistor, a third resistor and a fourth resistor; the negative feedback unit includes a second amplifier and a fifth resistor, wherein a terminal of the third resistor is connected to the drain of the first switching transistor; another terminal of the third resistor is connected to a terminal of the fifth resistor and a first input terminal of the first amplifier; a terminal of the first resistor is grounded, and another terminal of the first resistor is connected to a terminal of the second resistor and a second input terminal of the first amplifier; another terminal of the second resistor is connected to a terminal of the fourth resistor and an output terminal of the first amplifier; another terminal of the fourth resistor is connected to a first input terminal of the second amplifier; another terminal of the fifth resistor is connected to an output terminal of the second amplifier; a second input terminal of the second amplifier is connected to the output terminal of the second amplifier; and the first input terminal of the second amplifier is connected to the output module.

9. The driving apparatus of claim 1, wherein the first transistor, the second transistor, the fifth transistor, the sixth transistor and the tenth transistor are of the same polarity, and the third transistor, the fourth transistor, the seventh transistor, the eighth transistor and the ninth transistor are of the same polarity.

10. The driving apparatus of claim 1, wherein the first transistor, the second transistor, the third transistor, the fourth transistor, the fifth transistor, the sixth transistor, the seventh transistor, the eighth transistor, the ninth transistor and the tenth transistor are all Thin Film Transistors.

11. The driving apparatus of claim 1, wherein the output module is a lead wire, the output terminal of which is connected to the input terminal of the data line in the pixel circuit array.

12. An OLED panel including a substrate, a pixel circuit array formed on the substrate, and a driving apparatus, the driving apparatus includes:

a switching module for selecting and outputting a voltage signal according to a received clock signal;

a conversion module for converting the voltage signal into a current signal and outputting the current signal; and an output module for outputting the voltage signal or the converted current signal to drive a pixel circuit array, wherein a first output terminal of the switching module is connected to an input terminal of the conversion module, a second output terminal of the switching module is connected to an input terminal of the output module, and an output terminal of the conversion module is connected to an input terminal of the output module; and a voltage generating module configured to generate a data voltage signal;

wherein the conversion module includes a data voltage input unit for converting the data voltage signal into a data current signal, a threshold voltage compensating unit for compensating the threshold voltage of transistor, and a data current output unit for outputting the data current signal converted;

wherein the data voltage input unit includes a first transistor, a second transistor, a third transistor, a fourth transistor, and a ninth transistor;

the threshold voltage compensating unit includes a fifth transistor, a sixth transistor, a seventh transistor, and an eighth transistor; and the data current output unit includes a tenth transistor, wherein a gate of the first transistor is connected to the first output terminal of the switching module; a drain of the first transistor is connected to a drain and a gate of the third transistor and a gate of the fourth transistor; a source of the first transistor is connected to a source of the sixth transistor, a gate and a drain of the ninth transistor, and a source of the tenth transistor, and is grounded; a gate and a drain of the second transistor are connected to a gate of the fifth transistor, a drain of the fourth transistor and a gate of the tenth transistor; a source of the second transistor is connected to a source of the ninth transistor, a source of the fifth transistor and a gate of the sixth transistor; a source of the third transistor is connected to a source of the fourth transistor, a source of the seventh transistor and a source of the eighth transistor and a first power supply terminal VDD; a drain of the fifth transistor is connected to a drain and a gate of the seventh transistor, and a gate of the eighth transistor; a drain of the sixth transistor is connected to a drain of the eighth transistor; and a drain of the tenth transistor is connected to the second output terminal of the switching module and the input terminal of the output module.

13. The OLED panel of claim 12, wherein the driving apparatus further includes a clock signal generating module, wherein the clock signal generating module has an output terminal connected to a first input terminal of the switching module and is used for generating the clock signal; and the voltage generating module has an output terminal connected to a second input terminal of the switching module.

14. The OLED panel of claim 13, wherein the switching module includes a first switching transistor and a second switching transistor, wherein a gate of the first switching transistor is connected to a gate of the second switching transistor and the output terminal of the clock signal generating module;

a source of the first switching transistor is connected to a drain of the second switching transistor and the output terminal of the voltage generating module;

a drain of the first switching transistor is connected to the input terminal of the conversion module; and a source of the second switching transistor is connected to the input terminal of the output module.

15. The OLED panel of claim 14, wherein an input terminal of the data voltage input unit is connected to the first output terminal of the switching module, an output terminal of the data voltage input unit is connected to an input terminal of the threshold voltage compensating unit, an output terminal of the threshold voltage compensating unit is connected to an input terminal of the data current output unit, and an output terminal of the data current output unit is connected to the input terminal of the output module.

* * * * *